US005967029A

United States Patent [19]

Mayo

[11] Patent Number: 5,967,029

[45] Date of Patent: Oct. 19, 1999

[54] AUTOMATIC ALUMINUM CAN CRUSHER

[76] Inventor: Donald Mayo, 17514 Horace St., Granada Hills, Calif. 91344

[21] Appl. No.: 09/036,423

[22] Filed: Mar. 5, 1998

[51] Int. Cl.[6] ..... B30B 9/32

[52] U.S. Cl. ..... 100/99; 100/245; 100/256; 100/289; 100/902

[58] Field of Search ..... 100/49, 52, 245, 100/256, 289, 902, 99

[56] References Cited

U.S. PATENT DOCUMENTS

| | | | |
|---|---|---|---|
| 613,626 | 11/1898 | Gilliland | 100/289 |
| 2,128,630 | 8/1938 | Wright | 100/245 |
| 2,813,569 | 11/1957 | Nelson | 100/256 |
| 3,024,720 | 3/1962 | Welsh | 100/245 |
| 3,104,607 | 9/1963 | Galas | 100/902 |
| 3,232,220 | 2/1966 | Sileski | 100/52 |
| 3,604,345 | 9/1971 | Boje | 100/289 |
| 3,643,589 | 2/1972 | Carter | 100/256 |
| 3,960,070 | 6/1976 | McClure et al. | 100/256 |
| 4,235,164 | 11/1980 | Allen et al. | 100/245 |
| 4,240,341 | 12/1980 | Whipple et al. | 100/256 |
| 5,048,413 | 9/1991 | Deiters | 100/902 |

FOREIGN PATENT DOCUMENTS

| | | | |
|---|---|---|---|
| 2271952 | 5/1994 | United Kingdom | 100/902 |

*Primary Examiner*—Stephen F. Gerrity

[57] ABSTRACT

A new automatic aluminum can crusher for compacting aluminum cans for disposal includes an upper housing comprised of a first compartment and a second compartment. The first compartment has an open upper end with a lid hingedly coupled thereto. The first compartment has an opening through a bottom thereof. A crushing mechanism is disposed within the upper housing. An activation system is disposed interiorly of the upper housing and is in communication with the crushing mechanism.

7 Claims, 2 Drawing Sheets

AUTOMATIC ALUMINUM CAN CRUSHER

BACKGROUND OF THE INVENTION

1. Field of the Invention

The present invention relates to can compressors and more particularly pertains to a new automatic aluminum can crusher for compacting aluminum cans for disposal.

2. Description of the Prior Art

The use of can compressors is known in the prior art. More specifically, can compressors heretofore devised and utilized are known to consist basically of familiar, expected and obvious structural configurations, notwithstanding the myriad of designs encompassed by the crowded prior art which have been developed for the fulfillment of countless objectives and requirements.

Known prior art can compressors include U.S. Pat. No. 5,094,157 to Challis et al.; U.S. Pat. No. 5,417,154 to Plaats; U.S. Pat. No. 5,103,721 to Chou et al.; U.S. Pat. No. Des. 336,478 to Balbas et al.; U.S. Pat. No. 4,953,682 to Helbawi; and U.S. Pat. No. 4,474,108 to Lonze.

While these devices fulfill their respective, particular objectives and requirements, the aforementioned patents do not disclose a new automatic aluminum can crusher. The inventive device includes an upper housing comprised of a first compartment and a second compartment. The first compartment has an open upper end with a lid hingedly coupled thereto. The first compartment has an opening through a bottom thereof. A crushing mechanism is disposed within the upper housing. An activation system is disposed interiorly of the upper housing and is in communication with the crushing mechanism.

In these respects, the automatic aluminum can crusher according to the present invention substantially departs from the conventional concepts and designs of the prior art, and in so doing provides an apparatus primarily developed for the purpose of compacting aluminum cans for disposal.

SUMMARY OF THE INVENTION

In view of the foregoing disadvantages inherent in the known types of can compressors now present in the prior art, the present invention provides a new automatic aluminum can crusher construction wherein the same can be utilized for compacting aluminum cans for disposal.

The general purpose of the present invention, which will be described subsequently in greater detail, is to provide a new automatic aluminum can crusher apparatus and method which has many of the advantages of the can compressors mentioned heretofore and many novel features that result in a new automatic aluminum can crusher which is not anticipated, rendered obvious, suggested, or even implied by any of the prior art can compressors, either alone or in any combination thereof.

To attain this, the present invention generally comprises an upper housing comprised of a first compartment and a second compartment. The first compartment has an open upper end with a lid hingedly coupled thereto. The first compartment has an opening through a bottom thereof. A lower housing is disposed below the upper housing. The lower housing has an opening through an upper end thereof in communication with the opening the bottom of the first compartment. A crushing mechanism is disposed within the upper housing. The crushing mechanism crushes an aluminum can against a far wall of the first compartment for being received within the lower housing. The crushing mechanism includes a motor disposed within the second compartment.

The motor has a drive gear in communication therewith. The crushing mechanism includes a threaded shaft extending inwardly from an outer wall of the second compartment. The threaded shaft has a gear disposed thereon in communication with the drive gear. The threaded shaft has a drive collar coupled therewith. The collar has a pair of angularly disposed brackets extending outwardly therefrom. Free ends of the brackets have a drive ram secured thereto. The drive ram has a pair of tabs extending outwardly of opposed sides thereof for being slidably received within tracks disposed on opposed sides of the first compartment. An activation system is disposed interiorly of the upper housing. The activation system includes a circuit board that is in communication with the motor. The circuit board includes an upper micro switch in communication with the lid of the first compartment for activation of the motor. The circuit board includes a lower micro switch in communication with the drive ram for deactivation of the motor. The circuit board is in communication with a pair of lights disposed exteriorly of the upper housing to indicate activation and deactivation of the crushing mechanism. A pair of pivoting brackets are coupled with a lower surface of the lid and the opening in the bottom of the first compartment. The pivoting brackets each serve to dislodge a crushed aluminum can from the drive ram.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic aluminum can crusher apparatus and method which has many of the advantages of the can compressors mentioned heretofore and many novel features that result in a new automatic aluminum can crusher which is not anticipated, rendered obvious, suggested, or even implied by any of the prior art can compressors, either alone or in any combination thereof.

It is another object of the present invention to provide a new automatic aluminum can crusher which may be easily and efficiently manufactured and marketed.

It is a further object of the present invention to provide a new automatic aluminum can crusher which is of a durable and reliable construction.

An even further object of the present invention is to provide a new automatic aluminum can crusher which is susceptible of a low cost of manufacture with regard to both materials and labor, and which accordingly is then susceptible of low prices of sale to the consuming public, thereby making such automatic aluminum can crusher economically available to the buying public.

Still yet another object of the present invention is to provide a new automatic aluminum can crusher which provides in the apparatuses and methods of the prior art some of the advantages thereof, while simultaneously overcoming some of the disadvantages normally associated therewith.

Still another object of the present invention is to provide a new automatic aluminum can crusher for compacting aluminum cans for disposal.

Yet another object of the present invention is to provide a new automatic aluminum can crusher which includes an upper housing comprised of a first compartment and a second compartment. The first compartment has an open upper end with a lid hingedly coupled thereto. The first compartment has an opening through a bottom thereof. A crushing mechanism is disposed within the upper housing. An activation system is disposed interiorly of the upper housing and is in communication with the crushing mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
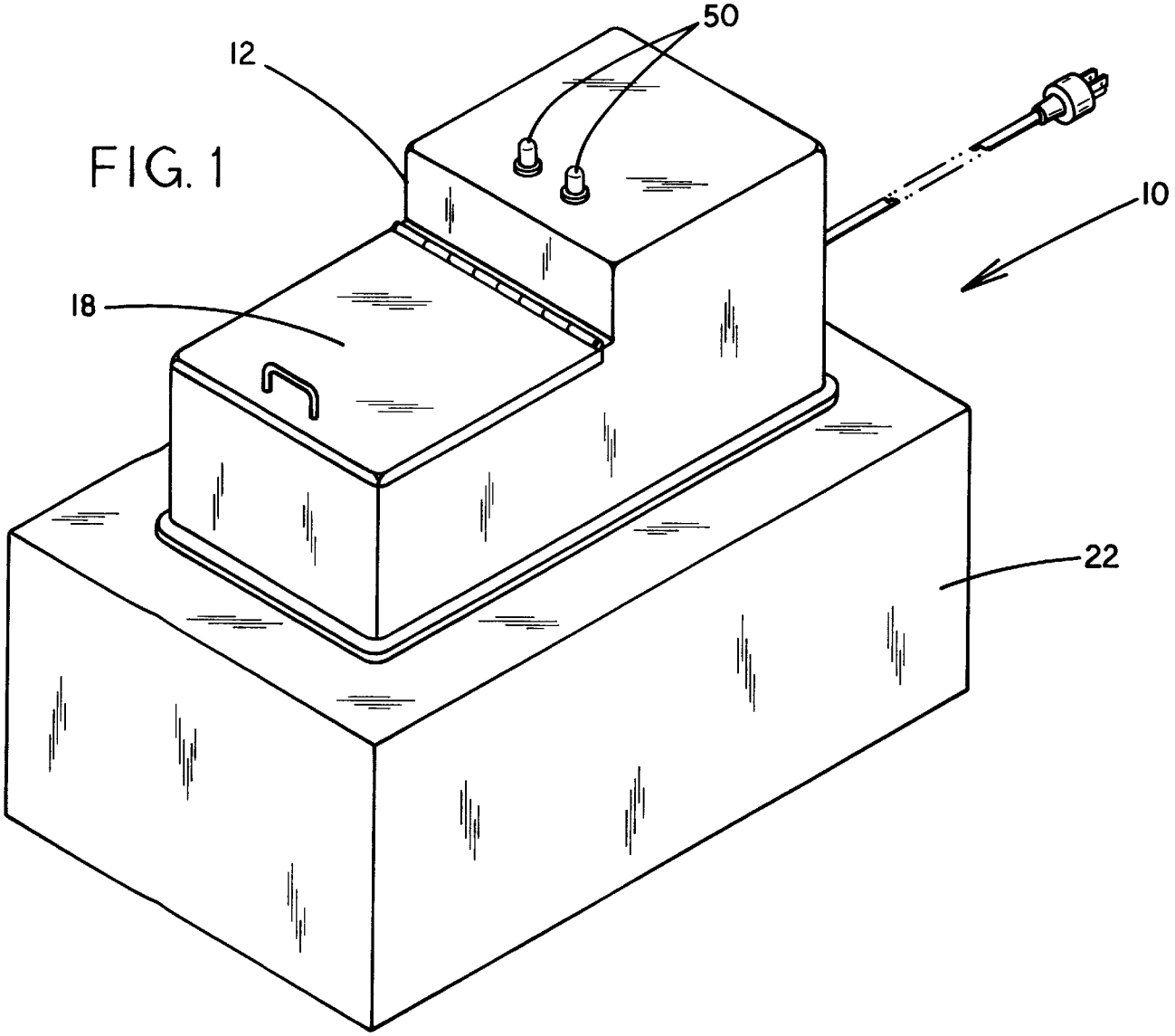
FIG. 1 is a perspective view of a new automatic aluminum can crusher according to the present invention.
Figure 2:
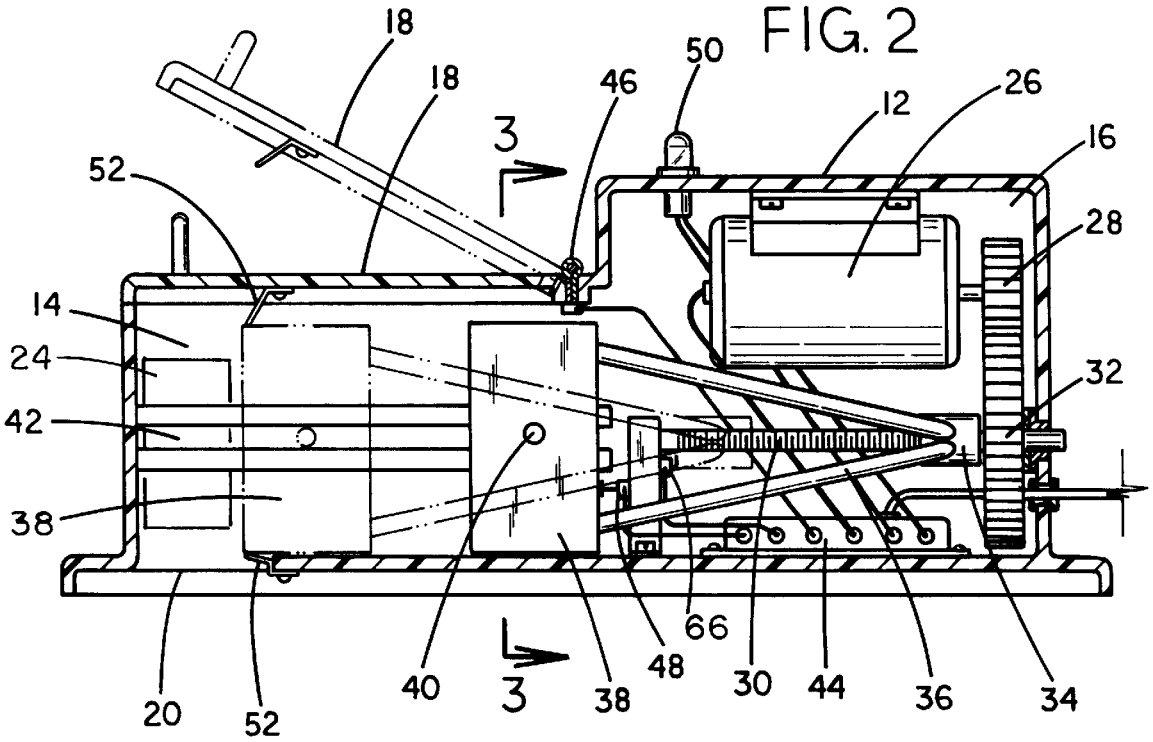
FIG. 2 is a cross-sectional side view of the present invention.
Figure 3:
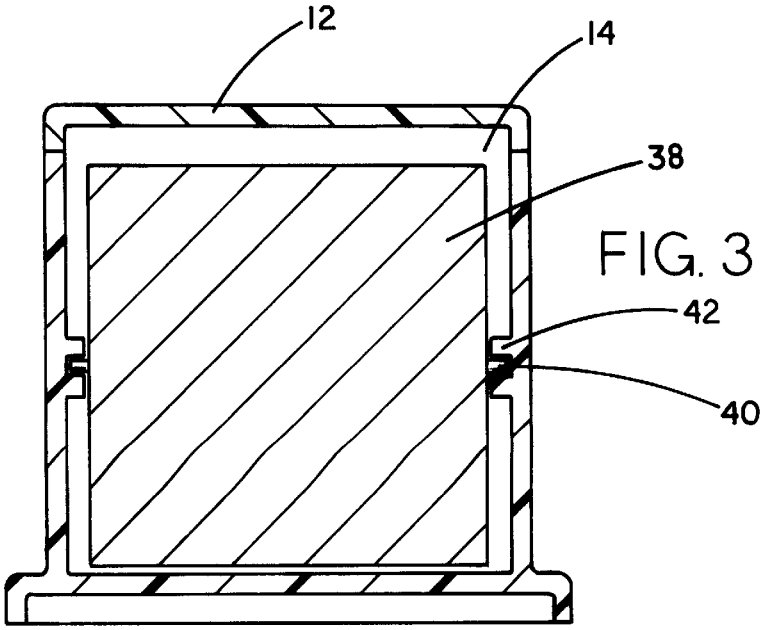
FIG. 3 is a cross-sectional view of the present invention as taken along line 3-3 of FIG. 2.

With reference now to the drawings, and in particular to FIGS. 1 through 3 thereof, a new automatic aluminum can crusher embodying the principles and concepts of the present invention and generally designated by the reference numeral 10 will be described.

As best illustrated in FIGS. 1 through 3, the automatic aluminum can crusher 10 comprises an upper housing 12 comprised of a first compartment 14 and a second compartment 16. The first compartment 14 has an open upper end with a lid 18 hingedly coupled thereto. The first compartment 14 has an opening 20 through a bottom thereof.

A lower housing 22 is disposed below the upper housing 12. The lower housing 22 has an opening through an upper end thereof in communication with the opening 20 the bottom of the first compartment 14.

A crushing mechanism is disposed within the upper housing 12. The crushing mechanism crushes an aluminum can 24 against a far wall of the first compartment 14 for being received within the lower housing 22. The crushing mechanism includes a motor 26 disposed within the second compartment 16. The motor 26 has a drive gear 28 in communication therewith. The crushing mechanism includes a threaded shaft 30 extending inwardly from an outer wall of the second compartment 16. The threaded shaft 30 has a gear 32 disposed thereon in communication with the drive gear 28. The threaded shaft 30 has a drive collar 34 coupled therewith. The collar 34 has a pair of angularly disposed brackets 36 extending outwardly therefrom. Free ends of the brackets 36 have a drive ram 38 secured thereto. The drive ram 38 has a pair of tabs 40 extending outwardly of opposed sides thereof for being slidably received within tracks 42 disposed on opposed sides of the first compartment 14.

An activation system is disposed interiorly of the upper housing 14. The activation system includes a circuit board 44 that is in communication with the motor 26. The circuit board 44 includes an upper micro switch 46 in communication with the lid 18 of the first compartment 14 for activation of the motor 26. The circuit board 44 includes a lower micro switch 48 in communication with the drive ram 38 for deactivation of the motor 26. The circuit board 44 is in communication with a pair of lights 50 disposed exteriorly of the upper housing 12 to indicate activation and deactivation of the crushing mechanism.

A pair of pivoting brackets 52 are coupled with a lower surface of the lid 18 and the opening 20 in the bottom of the first compartment 14. The pivoting brackets 52 each serve to dislodge a crushed aluminum can from the drive ram 38.

In use, the lid 18 is raise and an aluminum can is placed within the first compartment 14. The lid 18 is then closed thereby contacting the upper micro switch 46 which signal is transferred from the circuit board 44 to activate the motor 26. The motor 26 will cause the drive gear 28 to rotate thereby rotating the gear 32 of the threaded shaft 30. The gear 32 will cause the threaded shaft 30 to spin thereby causing the drive collar 34 to move forwardly which will cause the drive ram 38 to move forwardly against the aluminum can. The drive ram 38 will crush the aluminum can against the forward wall of the upper housing 12. As the drive ram 38 moves forward, the drive collar 34 contacts micro switch 66 such that the micro switch 66 causes the drive motor 26 to reverse. Then as the drive ram 38 retracts it will contact the micro switch 48 which in turn deactivates the drive motor 26. As the drive ram 38 retracts, the pivoting brackets 52 will contact the crushed can causing it to fall through the opening 20 in the bottom of the first compartment 14 and be deposited within the lower housing 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic aluminum can crusher for compacting aluminum cans for disposal comprising, in combination:

an upper housing comprised of a first compartment and a second compartment, the first compartment having an open upper end with a lid hingedly coupled to the first compartment, the first compartment further having tracks disposed on opposing sides of the first compartment, the first compartment having an opening through a bottom thereof;

a lower housing disposed below the upper housing, the lower housing having an opening through an upper end thereof in communication with the opening in the bottom of the first compartment;

a crushing mechanism disposed within the upper housing, the crushing mechanism crushing an aluminum can against a wall of the first compartment such that the crushed aluminum can is passable through the opening of the first compartment and into the lower housing, the crushing mechanism including a motor disposed within the second compartment, the motor having a drive gear in communication therewith, the crushing mechanism including a threaded shaft extending inwardly from a first wall of the second compartment, the threaded shaft having a gear disposed thereon in communication with the drive gear, the threaded shaft having a drive collar coupled therewith, the collar having a pair of angularly disposed brackets extending outwardly therefrom, free ends of the brackets having a drive ram secured thereto, the drive ram having a pair of tabs extending outwardly of opposed sides thereof for being slidably received within the tracks of the first compartment;

an activation system disposed interiorly of the upper housing, the activation system including a circuit board being in communication with the motor, the circuit board including an upper micro switch in communication with the lid of the first compartment for activation of the motor, the circuit board including a lower micro switch in communication with the drive ram for deactivation of the motor, the circuit board being in communication with a pair of lights disposed exteriorly of the upper housing to indicate activation and deactivation of the crushing mechanism; and a pair of pivoting brackets coupled with a lower surface of the lid and the opening in the bottom of the first compartment, the pivoting brackets each serving to dislodge a crushed aluminum can from the drive ram.

2. An automatic aluminum can crusher for compacting aluminum cans for disposal comprising, in combination:

an upper housing comprised of a first compartment and a second compartment, the first compartment having an open upper end with a lid hingedly coupled thereto, the first compartment having an opening through a bottom thereof:

a crushing mechanism disposed within the upper housing;

an activation system disposed interiorly of the upper housing and being in communication with the crushing mechanism;

wherein the crushing mechanism crushes an aluminum can against a wall of the first compartment such that the crushed aluminum can is passable through the opening of the first compartment and into a lower housing, the crushing mechanism including a motor disposed within the second compartment, the motor having a drive gear in communication therewith, the crushing mechanism including a threaded shaft extending inwardly from a first wall of the second compartment, the threaded shaft having a gear disposed thereon in communication with the drive gear, the threaded shaft having a drive collar coupled therewith, the collar having a pair of angularly disposed brackets extending outwardly therefrom, free ends of the brackets having a drive ram secured thereto.

3. The automatic aluminum can crusher as set forth in claim 2 and further including a lower housing disposed below the upper housing, the lower housing having an opening through an upper end thereof in communication with the opening in the bottom of the first compartment.

4. The automatic aluminum can crusher as set forth in claim 2 further comprising:

the first compartment having tracks disposed on opposed sides thereof; and wherein the drive ram has a pair of tabs extending outwardly of opposed sides thereof for being slidably received within tracks disposed on opposed sides of the first compartment.

5. The automatic aluminum can crusher as set forth in claim 2 wherein the activation system includes a circuit board in communication with the motor, the circuit board including an upper micro switch in communication with the lid of the first compartment for activation of the motor, the circuit board including a lower micro switch in communication with the drive ram for deactivation of the motor.

6. The automatic aluminum can crusher as set forth in claim 5 wherein the circuit board is in communication with a pair of lights disposed exteriorly of the upper housing to indicate activation and deactivation of the crushing mechanism.

7. The automatic aluminum can crusher as set forth in claim 2 and further including a pair of pivoting brackets coupled with a lower surface of the lid and the opening in the bottom of the first compartment, the pivoting brackets each serving to dislodge a crushed aluminum can from the drive ram.

* * * * *